US011944181B2

(12) United States Patent
Terruzzi

(10) Patent No.: US 11,944,181 B2
(45) Date of Patent: Apr. 2, 2024

(54) COSMETIC CONTAINER FOR APPLYING A LIPSTICK

(71) Applicant: AKRONIMEX S.R.L., Biassono (IT)

(72) Inventor: Alberto Terruzzi, Biassono (IT)

(73) Assignee: AKRONIMEX S.R.L., Biassono (IT)

( * ) Notice: Subject to any disclaimer, the term of this patent is extended or adjusted under 35 U.S.C. 154(b) by 594 days.

(21) Appl. No.: 17/261,632

(22) PCT Filed: Sep. 9, 2019

(86) PCT No.: PCT/IB2019/057574
§ 371 (c)(1),
(2) Date: Jan. 20, 2021

(87) PCT Pub. No.: WO2020/053733
PCT Pub. Date: Mar. 19, 2020

(65) Prior Publication Data

US 2021/0259391 A1 Aug. 26, 2021

(30) Foreign Application Priority Data

Sep. 10, 2018 (IT) ..... 102018000008463

(51) Int. Cl.
*A45D 40/06* (2006.01)

(52) U.S. Cl.
CPC ..... *A45D 40/065* (2013.01)

(58) Field of Classification Search
CPC ..... A45D 40/065; A45D 40/06; A45D 40/00
(Continued)

(56) References Cited

U.S. PATENT DOCUMENTS 1,862,271 A 6/1932 Levy
3,709,618 A 1/1973 Gruska
(Continued)

FOREIGN PATENT DOCUMENTS

EP 0571922 A1 12/1993
EP 0845229 A3 6/1998
(Continued)

OTHER PUBLICATIONS

Combined Russian Office Action and Search Report dated Aug. 31, 2022 in Patent Application No. 201102258/03 (with English machine translation).

(Continued)

*Primary Examiner* — Rafael A Ortiz
(74) *Attorney, Agent, or Firm* — Element IP, PLC

(57) ABSTRACT

Cosmetic container (10) for applying a cosmetic product (100) comprising a pass-through opening (35) for said cosmetic product (100), an outer cylindrical body (40) which comprises at least one inner helicoidal groove (47) and at least one outer helicoidal groove (49), an inner cylindrical body (60) which is rotatably mounted with the outer cylindrical body (40) about a longitudinal axis (L) along which they are concentric, where said inner cylindrical body (60) comprises at least one longitudinal guide slot (65), a support shuttle (70) for said cosmetic product (100) comprising at least one guide pin (75) which is slidingly engaged with said at least one longitudinal guide slot (65) and with said at least one inner helicoidal groove (47), a shutter (80) comprising at least one guide pin (85) which is slidingly engaged with said at least one outer helicoidal groove (49), said shutter (80) comprising a plurality of gores (87) being adapted to be bending deformed for opening and closing said pass-through opening (35).

13 Claims, 8 Drawing Sheets

(58) Field of Classification Search
USPC ..... 206/385
See application file for complete search history.

(56) References Cited

U.S. PATENT DOCUMENTS

| | | | | |
|---|---|---|---|---|
| 5,423,622 | A | 6/1995 | Perrotti | |
| 5,979,468 | A | 11/1999 | Blake, III | |
| 6,102,598 | A * | 8/2000 | Hsu | A45D 40/065 401/59 |
| 6,231,254 | B1 | 5/2001 | Holloway | |
| 9,809,052 | B2 | 11/2017 | Heipp | |
| 2006/0029456 | A1 | 2/2006 | Liu | |
| 2008/0163881 | A1 | 7/2008 | Saunders et al. | |

FOREIGN PATENT DOCUMENTS

| | | | | |
|---|---|---|---|---|
| GB | 2432147 | A * | 5/2007 | A45D 40/06 |
| KR | 20040034228 | A | 4/2004 | |
| RU | 2212835 | C2 | 9/2003 | |
| WO | WO-2004077986 | A1 * | 9/2004 | A45D 40/065 |
| WO | WO-2004077986 | A1 | 9/2004 | |

OTHER PUBLICATIONS

International Search Report dated Oct. 21, 2019 in PCT/IB2019/057574, 3 pages.
Written Opinion dated Oct. 21, 2019 in PCT/IB2019/057574, 6 pages.
Office Action dated Nov. 8, 2023 in Korean Patent Application No. 10-2021-7003406 (with machine English translation), 23 pages.

* cited by examiner 10
20
22
21
28
50
52
30
VII
VII
VIII
VIII
32
34
33
31
35
80
Σ
Π
L 10
20
22
26
28
52
50
38
48
49
30
47
32
85
80
44
95
91
47
62
92
31
64
80
87
L
87
60
63
47
85
37
49
47
49
47
65
47
46
40
47
70
42
75
66
25
24
25
66
24
21
23
67
43
Θ

30
31
35
80
97
87
V
97
98
87
87
IV
IV

COSMETIC CONTAINER FOR APPLYING A LIPSTICK

The present invention relates to a cosmetic container for applying a lipstick or another cosmetic product.

In the state of the art, cosmetic containers are known for applying a lipstick or another cosmetic product such as, for example, the cosmetic container described in the patent EP 0815767 B1 own by the Applicant which comprises a through opening for the cosmetic product, a hollow inner cylindrical body, a hollow outer cylindrical body and a support for the cosmetic product that is slidingly mounted with the inner cylindrical body. The inner cylindrical body is rotatably mounted with the outer cylindrical body so that they can be rotated relative to one another about a longitudinal axis along which they are concentric. The inner cylindrical body comprises two longitudinal guides. The outer cylindrical body comprises two first helicoidal guides and a second helicoidal guide. The support comprises two guide pins. Each guide pin of the support passes through a respective longitudinal guide of the inner cylindrical body and is channelled in a respective first helicoidal guide of the outer cylindrical body to be guided during a rotation step of the inner cylindrical body with respect to the outer cylindrical body. A foldable shutter is slidingly mounted with the second helicoidal guide of the outer cylindrical body so that during the rotation step the foldable shutter makes the container pass from a closed position when the shutter covers the pass-through opening to an open position where the shutter leaves the pass-through opening free in order to make the cosmetic product pass outside the pass-through opening of the container.

Disadvantageously, because of wear due to use, the shutter can bend and not slide any longer with sufficient fluidity such that it can interfere with the cosmetic product in the passage from the closed position to the open position of the container, ruining the cosmetic product.

Disadvantageously, the opening speed of the shutter and the lifting speed of the support must be well adjusted making the realization of the container difficult as it is necessary to carefully adjust the slope variations of the second helicoidal guide as a function of the dimensions of the shutter.

Disadvantageously, the covers must have a cross section with a quadrangular geometry and the operation of the shutter is not adapted to containers with a cross section with a circular geometry.

The aim of the present invention consists of the fact that a cosmetic container for applying a cosmetic product is realized that overcomes the disadvantages of the prior art and that is simpler to realize, more solid and longer-lasting.

According to the invention, this object is achieved by a container according to claim 1.

Other characteristics are provided in the dependent claims.

The features and advantages of the present invention will be more apparent from the following description, which is to be understood as exemplifying and not limiting, with reference to the appended schematic drawings, wherein.

With reference to the cited figures a cosmetic container 10 for applying a cosmetic product 100 is shown such as, for example, a lipstick, a lip gloss or a lip balm.

Figure 1:
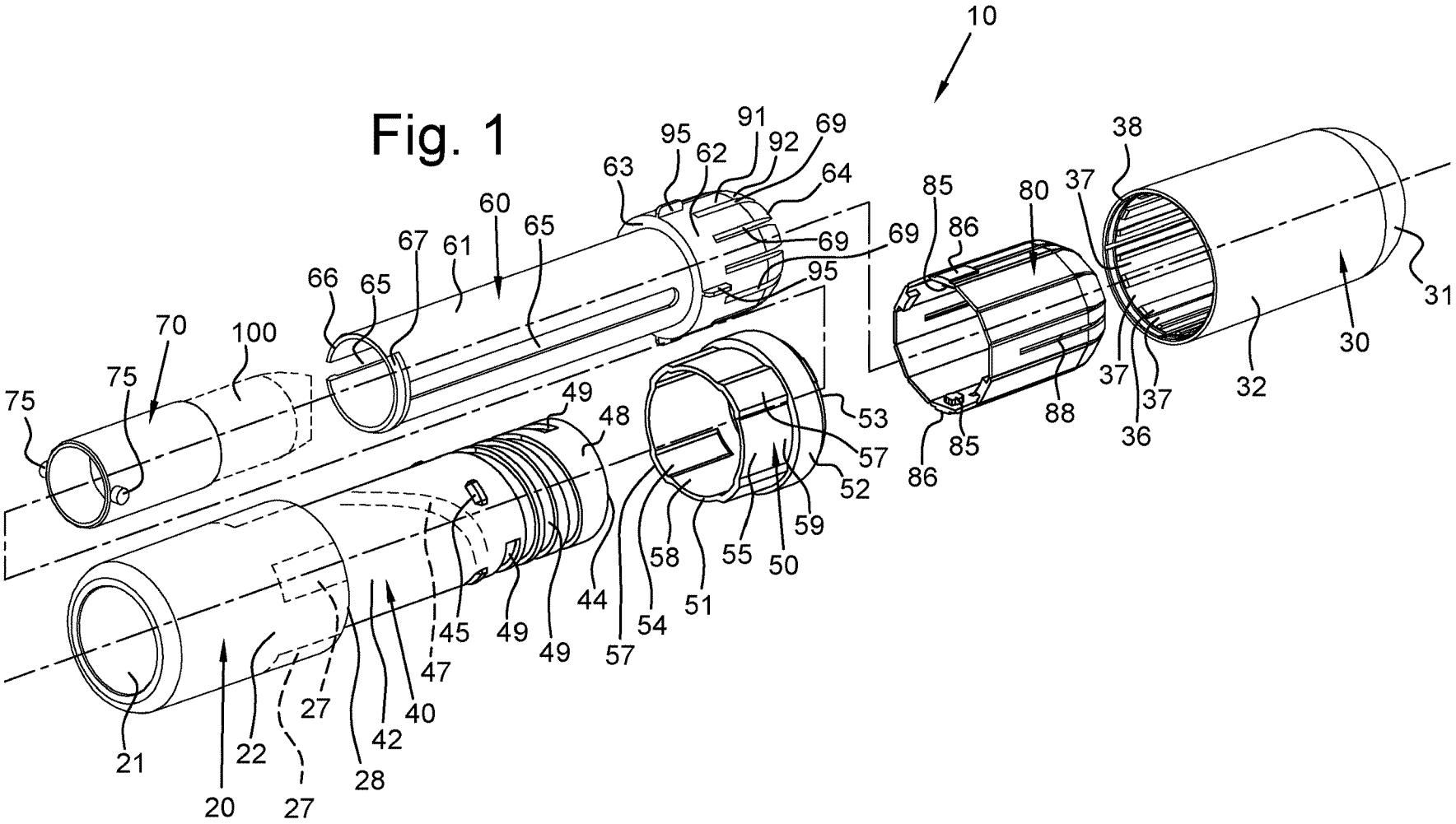
FIG. 1 is an exploded perspective view of a cosmetic container according to the present invention.

As shown in particular in FIG. 1, the cosmetic container 10 comprises a lower outer container 20, an upper outer container 30, an outer cylindrical body 40, a ring nut 50, an inner cylindrical body 60, a support shuttle 70 for a cosmetic product 100 and a shutter 80.

The lower outer container 20 and the upper outer container 30 are rotatably mounted with one another and adapted to rotate about a longitudinal axis L. The lower outer container 20 is concentric with the upper outer container 30 along the longitudinal axis L.

The lower 20 and upper 30 outer containers comprise a cross section with the same diameter, where the cross sections correspond at least to the portions of the two outer containers 20, 30 that are in abutment against the ring nut 50.

The longitudinal axis L corresponds to a mounting axis along which the lower outer container 20, the outer cylindrical body 40, the ring nut 50, the support shuttle 70, the inner cylindrical body 60, the shutter 80 and the upper outer container 30 of the cosmetic container 10 are mounted, as illustrated in FIG. 1.

As shown in particular in FIGS. 1, 4-7, 14-17, the lower outer container 20 comprises a bottom 21 from which walls 22 project along directions parallel to the longitudinal axis L and is substantially shaped like a hollow geometric cylinder comprising a closed lower geometric base that corresponds to the bottom 21 and an open upper geometric base turned towards the upper outer container 30 that corresponds to an upper pass-through opening 28 of the lower outer container 20. The bottom 21 of the lower outer container 20 comprises an inner face 23, where inner means that it is contained between the walls 22 and turned towards the upper outer container 30.

The lower outer container 20 comprises inner walls 24 that rise from the inner face 23 of the bottom 21 forming a hollow geometric cylinder that comprises an open upper geometric base that is turned towards the second outer container 30. The inner walls 24 rise from the inner face 23 of the bottom 21 for a length corresponding to a fraction of a length of the walls 22 of the lower outer container 20, where the lengths are measured along directions parallel to the longitudinal axis L. The length of the inner walls 24 and the length of the walls 22 are measured starting from the bottom 21.

The inner walls 24 comprise a plurality of radial flaps 25 that project both along a radial direction from an inner surface of the inner walls 24 turned towards the longitudinal axis L, and along directions parallel to the longitudinal axis L and directed towards the upper outer container 30 projecting for a fraction of a length of the inner walls 24 and starting to measure from the bottom 21 the length of the radial flaps exceeds the length of an edge of the open geometric base of the geometric cylinder formed by the inner walls 24.

The walls 22 of the lower outer container 20 comprise an inner surface 26. The inner surface 26 of the walls 22 comprises a plurality of grooves 27 hollowed in the walls 22 and arranged radially at regular spatial intervals with respect to the longitudinal axis L. Each of these grooves 27 hollows a seat in the walls 22. Each groove 27 starts from the upper pass-through opening 28 of the lower outer container 20 up to a fraction of length of the wall 22 measured starting from the upper pass-through opening 28 and proceeding towards the bottom 21.

Figure 2:
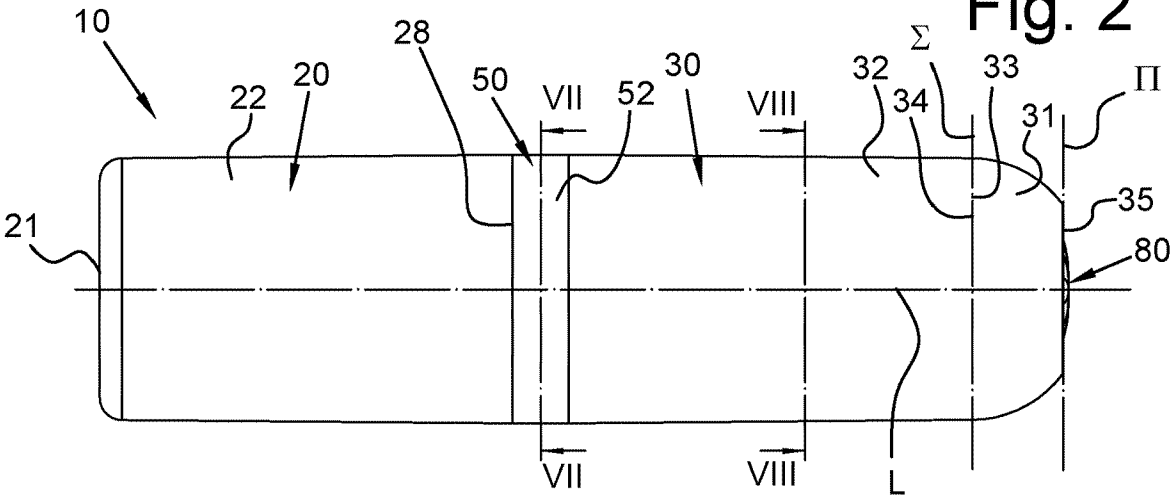
FIG. 2 is a side view of the cosmetic container in the closed position.

As shown in particular in FIGS. 1 and 2, the upper outer container 30 comprises a lower portion 32 and an upper portion 31 integral with one another.

The lower portion 32 of the upper outer container 30 is shaped like a hollow geometric cylinder comprising an open lower geometric base turned towards the lower outer container 20 that corresponds to a lower pass-through opening 38 in the upper outer container 30 and an open upper geometric base 34 turned towards the upper portion 31.

The walls of the hollow geometric cylinder of the lower portion 32 extend in parallel directions to the longitudinal axis L.

The upper portion 31 of the upper outer container 30 comprises walls shaped like a hollow geometric hemisphere and truncated by two geometric planes parallel between them and perpendicular to the longitudinal axis L.

A first geometric plane Σ of these two geometric planes identifies an open lower geometric base 33 of the upper portion 31, where this open lower geometric base 33 of the upper portion 31 rests on the open upper geometric base 34 of the lower portion 32. The open lower geometric base 33 of the upper portion 31 has the same shape and size as the open upper geometric base 34 of the lower portion 32. The open lower geometric base 33 of the upper portion 31 is concentric with the open upper geometric base 34 of the lower portion 32.

A second geometric plane II of these two geometric planes identifies an upper geometric base of the upper portion 31 that identifies a pass-through opening 35 of the upper outer container 30. The dimensions of the through opening 35 of the upper outer container 30 are adapted to make sure that the cosmetic product 100 can pass through it without interferences.

Figure 8:
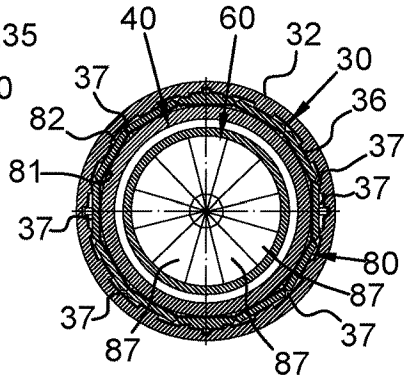
FIG. 8 is a sectional view according to the line VIII-VIII in FIG. 2.

As shown in particular in FIGS. 1, 8, the wall of the lower portion 32 comprises an inner surface 36. The inner surface 36 of the lower portion 32 comprises a plurality of longitudinal grooves 37 hollowed in the lower portion 32 and arranged radially at regular spatial intervals with respect to the longitudinal axis L. Each of these longitudinal grooves 37 hollows a seat in the lower portion 32. Each longitudinal groove 37 starts from the lower pass-through opening 38 of the lower portion 32 of the upper outer container 30 and extends for the entire length of the lower portion 32 measured starting from the open lower geometric base 38 and proceeding towards the pass-through opening 35.

As shown in particular in FIGS. 1, 4-6, 14-16 the support shuttle 70 for the cosmetic product 100 is substantially a cylinder. The support shuttle 70 comprises an upper support cavity adapted to support and contain a lower portion of the cosmetic product 100 and two guide pins 75 arranged at 180 sexagesimal degrees between each other and that project towards the outside in the radial direction. The two guide pins 75 are arranged on a same geometric plane that is perpendicular to the longitudinal axis L.

The support shuttle 70 is slidingly mounted with the inner cylindrical body 60.

As shown in particular in FIGS. 1, 4-7, 14-16 the outer cylindrical body 40 is mounted integrally with the lower outer container 20 by means of the ring nut 50.

The outer cylindrical body 40 is concentric with the lower outer container 20 along the longitudinal axis L.

The diameter of the cross section of the outer cylindrical body 40 is less than the diameter of the cross section of the lower outer container 20.

The walls 22 of the lower outer container 20 surround at least a lower portion of the outer cylindrical body 40.

The outer cylindrical body 40 comprises two ends, a lower end comprises a lower pass-through opening 43 and an upper end comprises an upper pass-through opening 44.

The outer cylindrical body 40 is substantially shaped like a hollow geometric cylinder comprising an open lower geometric base that corresponds to the lower pass-through opening 43 and an open upper geometric base that corresponds to the upper pass-through opening 44 of the outer cylindrical body 40.

The outer cylindrical body 40 comprises walls 42 that in turn comprise an inner surface 46 hollowed with a double inner helicoidal groove 47 and an outer surface 48 hollowed with a double outer helicoidal groove 49.

The double inner helicoidal groove 47 wraps around the longitudinal axis L according to a first direction while the double outer helicoidal groove 49 wraps around the longitudinal axis L according to a second direction opposite to said first direction so that when the support shuttle 70 rises upwards, the shutter 80 is made to slide downwards.

The double inner helicoidal groove 47 comprises a first inner helicoidal groove and a second inner helicoidal groove staggered by 180 sexagesimal degrees so as to be able to act as a guide for the two guide pins 75 of the support shuttle 70 for the cosmetic product 100. The double inner helicoidal groove 47 advantageously allows the geometric plane on which the two guide pins 75 of the support shuttle 70 lie to be kept perpendicular to the longitudinal axis L and therefore advantageously allows the support shuttle 70 to move from the bottom 21 to the pass-through opening 35 and vice versa in rotation relative to the outer cylindrical body 40 without the cosmetic product 100 interfering with any of the walls of the cosmetic container 10 and therefore without the cosmetic product 100 being able to get ruined.

The double inner helicoidal groove 47 extends in length along the entire inner surface 46 of the outer cylindrical body 40.

The double outer helicoidal groove 49 comprises a first outer helicoidal groove and a second outer helicoidal groove staggered by 180 sexagesimal degrees so as to be able to act as a guide for the two guide pins 85 of the shutter 80.

The double outer helicoidal groove 49 extends for a fraction of the length of the outer surface 48 of the outer cylindrical body 40. The double outer helicoidal groove 49 is provided at an upper portion of the outer cylindrical body 40, where the upper portion is the one at the upper pass-through opening 44 of the outer cylindrical body 40.

Each inner helicoidal groove 47 has a first regular pitch that is maintained for its whole projection in length. This second pitch does not change according to the height of the bottom 21 making it easy to produce the cosmetic container 10.

Each outer helicoidal groove 49 has a second regular pitch that is maintained for its whole projection in length. This second pitch does not change according to the height of the bottom 21 making it easy to produce the cosmetic container 10.

The double inner helicoidal groove 47 has a first pitch different from the second pitch of the double outer helicoidal groove 49 so that during the relative rotation step of the outer cylindrical body 40 with respect to the inner cylindrical body 60, the movement of the support shuttle 70 from the bottom 21 to the pass-through opening 35 is synchronized with a movement of the shutter 80 that passes from a closed position where the shutter 80 covers the pass-through opening 35 to an open position where the shutter 80 leaves the pass-through opening 35 free advantageously without interfering with the cosmetic product 100 and therefore without ruining the cosmetic product 100.

In particular in the figures it is shown that the first pitch of each internal helicoidal groove 47 is greater than the second pitch of each outer helicoidal groove 49.

The two different pitches of the two double inner 47 and outer 49 grooves depend on the dimensions of the support shuttle 70, the dimensions of the cosmetic product 100 and the dimensions of the shutter 80.

The outer surface 48 of the wall 42 of the outer cylindrical body 40 comprises a plurality of retainers 45 that project radially towards the outside, rising from the outer surface 48 at mutually regular spatial intervals.

As shown in particular in FIGS. 1, 4-7, 14-16, the ring nut 50 comprises two ends, a lower end comprises a lower pass-through opening 51 and an upper end comprises an upper pass-through opening 53.

The ring nut 50 is substantially shaped like a hollow geometric cylinder comprising an open lower geometric base that corresponds to the lower pass-through opening 51 and an open upper geometric base that corresponds to the upper through opening 53 of the ring nut 50.

The ring nut 50 comprises walls 55 that project along parallel directions to the longitudinal axis L and that form the walls of the hollow geometric cylinder.

The walls 55 of the ring nut 50 comprise an inner surface 58 where the plurality of inner grooves 54 is obtained, arranged radially at mutually regular spatial intervals with respect to the longitudinal axis L.

The plurality of retainers 45 of the outer cylindrical body 40 corresponds to the plurality of inner grooves 54 of the ring nut 50.

Each inner groove 54 of the ring nut 50 hollows a seat in the wall 55 of the ring nut 50. Each inner groove 54 of the ring nut 50 starts from the lower pass-through opening 51 and extends for a fraction of the length of the wall 55 of the ring nut 50 measured starting from the lower pass-through opening 51 towards the upper pass-through opening 53 of the ring nut 50.

An upper portion of the inner surface 58 of the wall 55 of the ring nut 50 is not hollowed from the inner groove 54, so that the inner groove 54 is adapted to be the seat of the respective retainer 45 of the outer cylindrical body 40.

Figure 7:
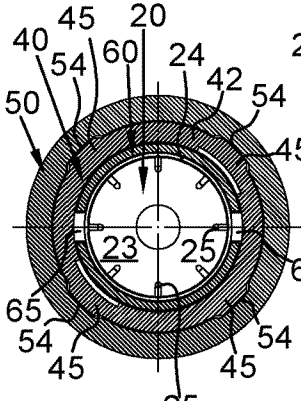
FIG. 7 is a sectional view according to the line VII-VII in FIG. 2.

As shown in particular in FIG. 7, the ring nut 50 fits onto the outer cylindrical body 40 from the outside so that the plurality of retainers 45 slide along the whole extension in length of the inner groove 54 of the ring nut 50 until stopping at the upper portion of the inner surface 58 of the wall 55 of the ring nut 50 so that the ring nut 50 remains integral with the outer cylindrical body 40.

At each inner groove 54 of the ring nut 50 the outer surface 59 of the wall 55 of the ring nut 50 comprises swellings that form the plurality of retainers 57 of the ring nut 50.

Each retainer 57 of the plurality of retainers 57 of the ring nut 50 projects in a radial direction towards the outside of the ring nut 50. Each retainer 57 of the ring nut 50 radially lifts the dimensions of the wall 55.

The plurality of grooves 27 hollowed in the walls 22 of the lower outer container 20 correspond to the plurality of retainers 57 of the ring nut 50. The shape of each groove 27 of the lower outer container 20 is complementary to the shape of each retainer 57 of the ring nut 50.

The plurality of retainers 57 of the ring nut 50 slide in the plurality of grooves 27 of the lower outer container 20 along the whole length of the grooves 27 so that the ring nut 50 remains integral with the lower outer cover 20.

The ring nut 50 comprises a swollen portion 52 that brings the outer diameter of the wall 55 to be equal to the outer diameter of the lower outer container 20 and equal to the outer diameter of the upper outer container 30.

The swollen portion 52 of the ring nut 50 forms two steps with the outer surface 59 of the wall 55 of the ring nut 50. A first step acts as a stopping surface for the edge of the upper pass-through opening 28 of the lower outer container 20 and the second step acts as a stopping surface for the edge of the lower pass-through opening 38 of the upper outer container 30.

As shown in particular in FIGS. 1, 4-7, 14-16, the inner cylindrical body 60 is rotatably mounted with the outer cylindrical body 40 so that they can be rotated relative to one another about the longitudinal axis L along which they are concentric.

The inner cylindrical body 60 comprises a lower portion 61 and an upper portion 62 integral with each other.

The lower portion 61 of the inner cylindrical body 60 is shaped like a hollow geometric cylinder comprising a lower geometric base open towards the lower outer container 20 that corresponds to a lower pass-through opening 66 of the inner cylindrical body 60.

Walls of the hollow geometric cylinder of the lower portion 61 extend in parallel directions to the longitudinal axis L.

The lower portion 61 has a diameter of the cross section adapted to allow the insertion of the lower portion 61 between the walls 42 of the outer cylindrical body 40.

The lower portion 61 of the inner cylindrical body 60 comprises two longitudinal guide slots 65. Each longitudinal guide slot 65 is a slot passing through the body of the inner cylindrical body 60.

The two longitudinal guide slots 65 are arranged at 180 sexagesimal degrees between each other so as to be adapted to guide seats for the two guide pins 75 of the support shuttle 70.

Each guide pin 75 of the support shuttle 70 passes through a respective longitudinal guide slot 65 of the inner cylindrical body 60 and is channelled in a single respective inner helicoidal groove 47 of the double inner helicoidal groove 47 of the outer cylindrical body to be guided during a relative rotation step of the outer cylindrical body 40 with respect to the inner cylindrical body 60.

As shown in particular in FIG. 7, the inner walls 24 of the lower outer container 20 and the wall 42 of the outer cylindrical body 40 are advantageously adapted to act as a guide for the rotation of the walls of the inner cylindrical body 60 during the relative rotation with respect to the outer cylindrical body 40.

As shown in particular in FIGS. 1, 4, 5, 14, 15 the lower portion 61 of the inner cylindrical body 60 has a longer length than the length of the outer cylindrical body 40.

Lower edges 67 of the inner cylindrical body 60 at the lower pass-through opening 66 rise radially towards the outside so as to constitute a step for locking in place edges of the lower pass-through opening 43 of the outer cylindrical body 40, thus fitting the lower portion 61 of the inner cylindrical body inside the outer cylindrical body 40.

As shown in particular in FIG. 1 a portion of the lower edge 67 of the inner cylindrical body 60 at one of the two longitudinal guide slots 65 is open so as to make the lower edge 67 discontinuous and allow the insertion of one of the guide pins 75 of the support shuttle 70 and make the lower portion 61 of the inner cylindrical body 60 sufficiently flexible so that the other guide pin 75 can be inserted in the other longitudinal guide slot 65, where the lower edge 67 is closed.

Figure 4:
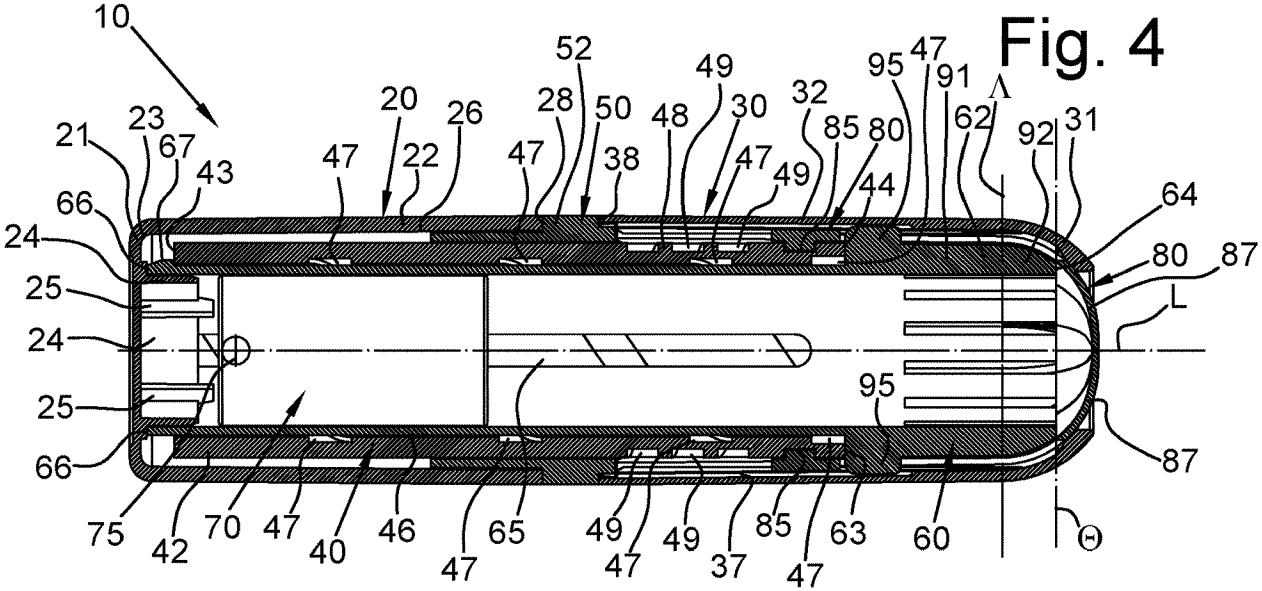
FIG. 4 is a sectional view according to the line IV-IV in FIG. 3 without the cosmetic product.
Figure 5:
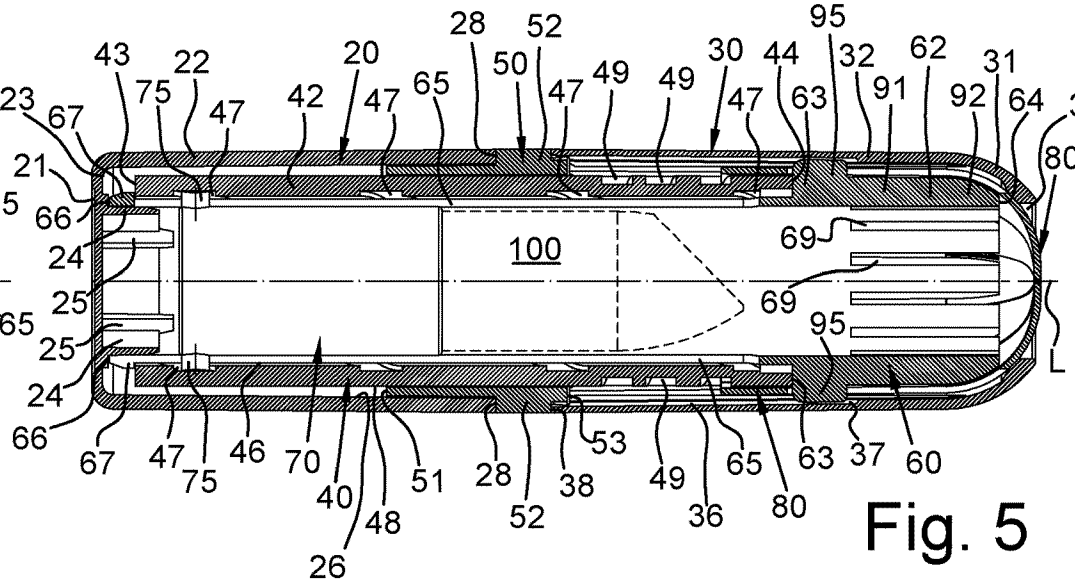
FIG. 5 is a sectional view according to the line V-V in FIG. 3 with the cosmetic product.
Figure 6:
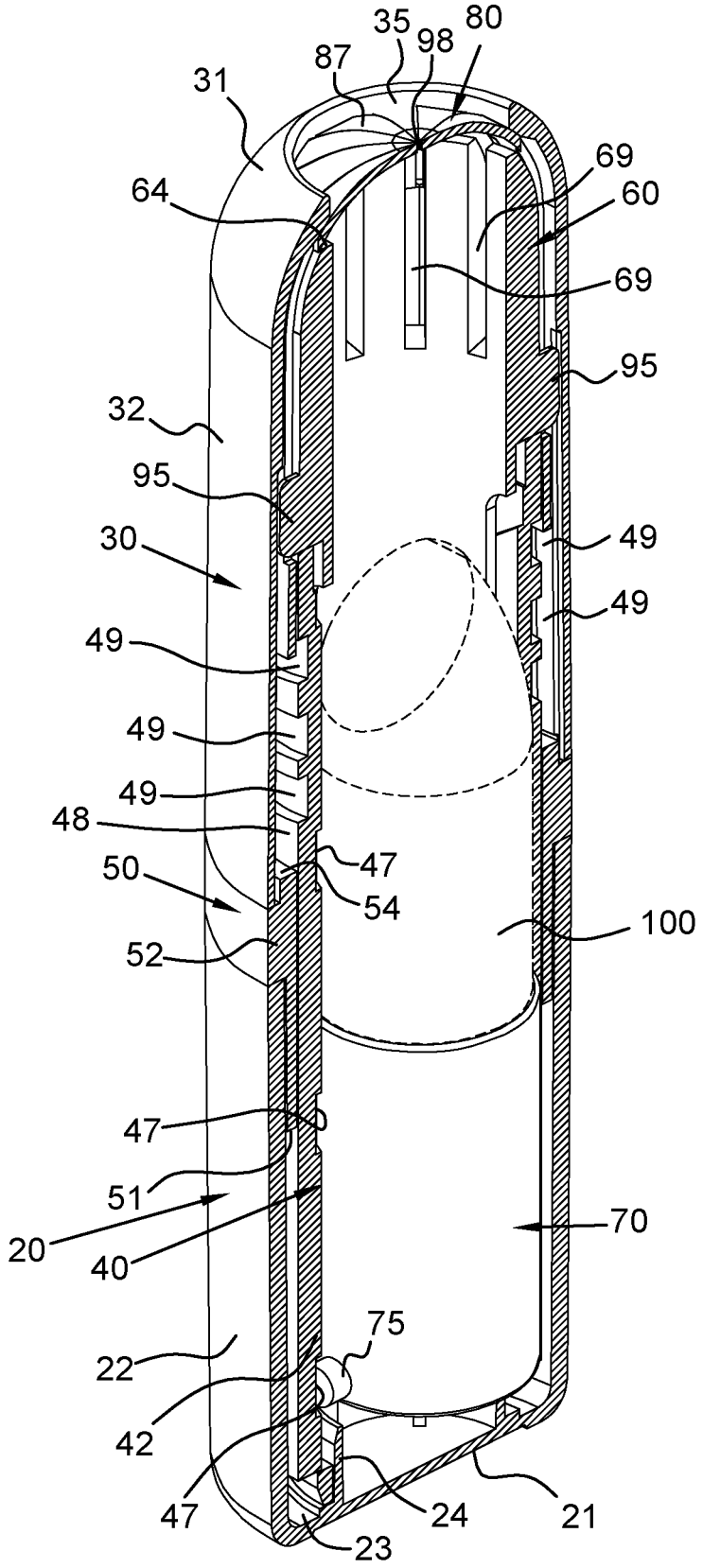
FIG. 6 is a perspective view of the section of FIG. 5.

As shown in particular in FIGS. 4-6, thanks to the fact that they surpass in length the edge of the open geometric base of the geometric cylinder formed by the inner walls 24 of the outer container, the radial flaps 25 of the lower outer container 20 advantageously allow the support shuttle 70 to act as an end stop, preventing the guide pins 75 of the support shuttle 70 exiting from the inner guides.

As shown in particular in FIGS. 4-6, 14-16 the upper portion 62 of the inner cylindrical body 60 comprises an inner surface that maintains the same inner diameter as the cross section of the lower portion 61 of the inner cylindrical body 60 and an outer surface that is raised with respect to the outer diameter of the cross section of the lower portion 61 such as to create a step 63.

As shown in particular in FIGS. 1, 4-6, 14, 16, a lower surface of the step 63 between the lower portion 61 and the upper portion 62 of the inner cylindrical body 60 abuts against an upper edge of the upper pass-through opening 44 of the outer cylindrical body 40.

The outer surface of the upper portion 62 of the inner cylindrical body 60 extends radially so that the outer diameter of the cross section of the upper portion 62 is equal to the outer diameter of the cross section of the upper portion of the outer cylindrical body 40.

The upper portion 62 of the inner cylindrical body 60 comprises in turn a lower portion 91 and an upper portion 92 integral with each other.

The lower portion 91 of the upper portion 62 of the inner cylindrical body 60 is shaped like a hollow geometric cylinder comprising an open lower geometric base that corresponds to the edge of the step 63 and an open upper geometric base turned towards the upper portion 92 of the upper portion 62 of the inner cylindrical body 60. Walls of the hollow geometric cylinder of the lower portion 91 of the upper portion 62 of the inner cylindrical body 60 extend in parallel directions to the longitudinal axis L.

As shown in particular in FIG. 4 the upper portion 92 of the upper portion 62 of the inner cylindrical body 60 comprises walls shaped like a hollow geometric hemisphere and truncated by another two mutually parallel geometric planes perpendicular to the longitudinal axis L.

A third geometric plane Θ of these other two geometric planes identifies an open lower geometric base of the upper portion 92 of the upper portion 62 of the inner cylindrical body 60, where this open lower geometric base of the upper portion 92 rests on the open upper geometric base of the lower portion 91. The open lower geometric base of the upper portion 92 has the same shape and size as the open upper geometric base of the lower portion 91. The open lower geometric base of the upper portion 92 is concentric with the open upper geometric base of the lower portion 91 of the upper portion 62 of the inner cylindrical body 60.

A fourth geometric plane A of these other two geometric planes identifies an upper geometric base of the upper portion 92 of the upper portion 62 of the inner cylindrical body 60 that identifies a pass-through opening 64 of the inner cylindrical body 60. The dimensions of the upper pass-through opening 64 of the inner cylindrical body 60 are adapted to make sure that the cosmetic product 100 can pass through it without interferences.

As shown in particular in FIG. 1, 4-6, 8, 14-16 between the upper portion 62 of the inner cylindrical body 60, the outer surface 48 hollowed with the double outer helicoidal groove 49 of the outer cylindrical body 40 and the inner surface 36 of the upper outer container 30 a compartment is formed adapted for the sliding of the shutter 80.

The truncated hemispheric shape of the upper portion 92 of the upper portion 62 of the inner cylindrical body 60 and the truncated hemispherical shape of the upper portion 31 of the upper outer container 30 are adapted to keep the shutter 80 deformed while maintaining the bending thereof.

The upper portion 62 of the inner cylindrical body 60 comprises a plurality of guide flaps 95 that extend from the outer surface of the upper portion 62 of the inner cylindrical body 60 in the radial direction towards the outside.

These guide flaps 95 are advantageously adapted to engage the shutter 80 integrally with the inner cylindrical body 60 so that the shutter 80 moves together with the inner cylindrical body 60 in its relative rotation motion with respect to the outer cylindrical body 40.

The upper portion 62 of the inner cylindrical body 60 comprises a plurality of pass-through longitudinal slots 69 that place in air communication the inner surface and the outer surface of the inner cylindrical body 60.

Figure 9:
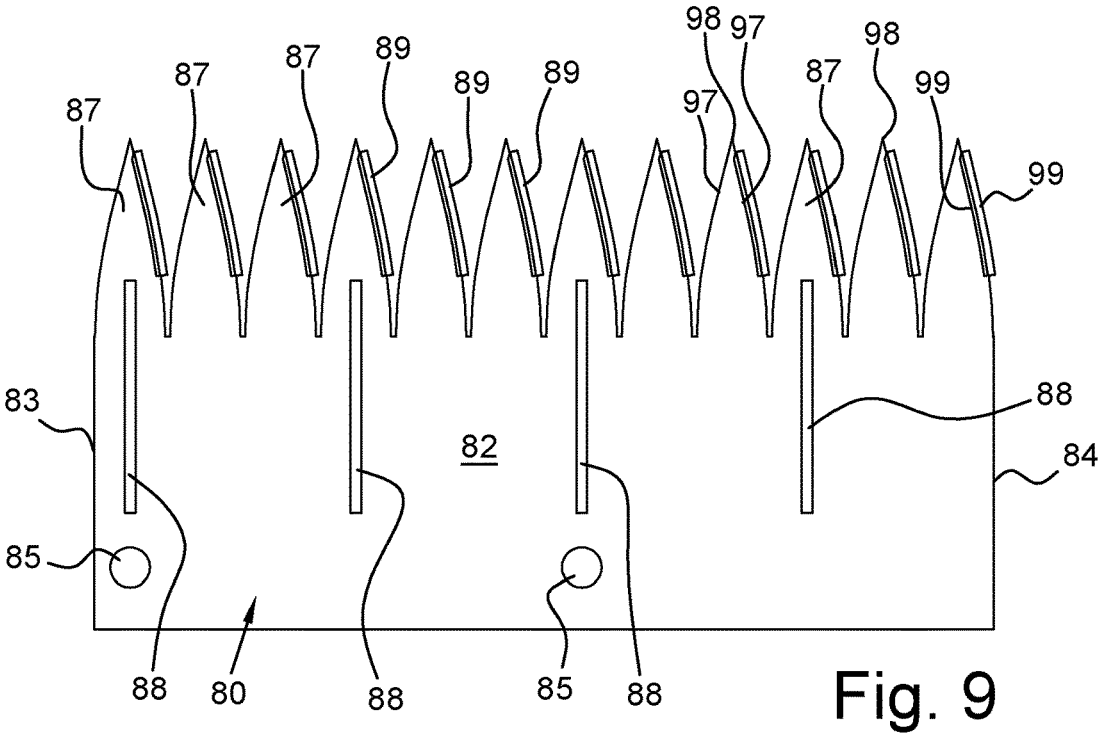
FIG. 9 is an unbent view of an outer face of a shutter of the cosmetic container.
Figure 10:
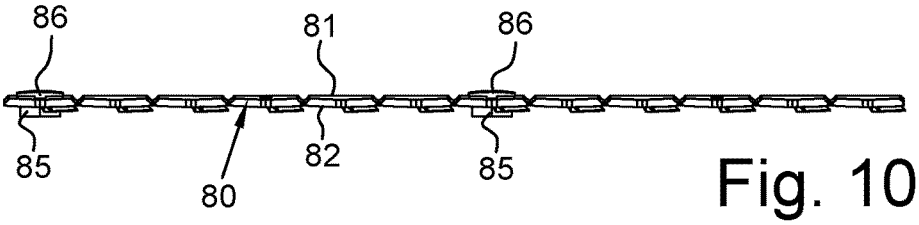
FIG. 10 is an unbent view from above of a shutter of the cosmetic container.
Figure 11:
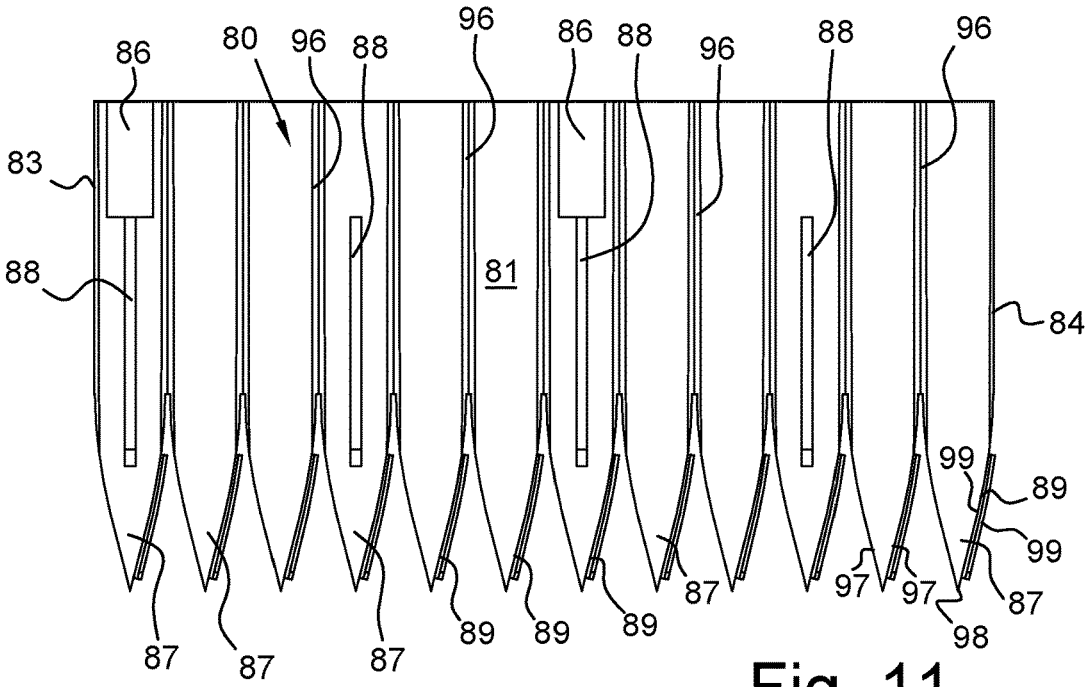
FIG. 11 is an unbent view of an inner face of a shutter of the cosmetic container.
Figure 12:
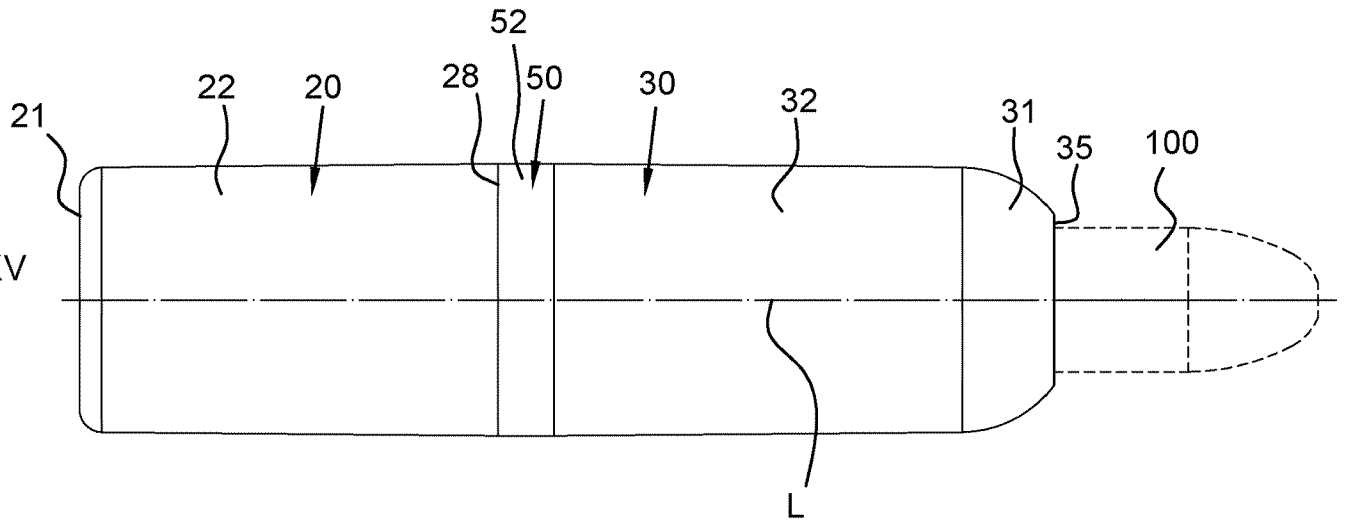
FIG. 12 is a side view of the cosmetic container in the open position.
Figure 13:
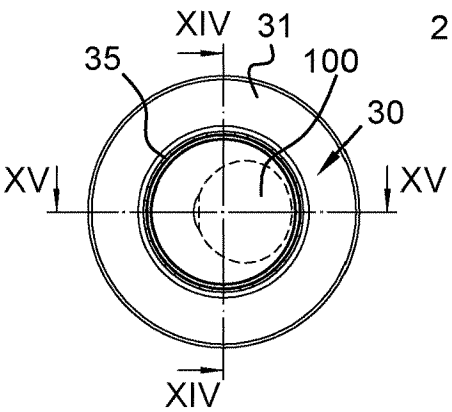
FIG. 13 is a view from above of the cosmetic container in the open position.
Figure 14:
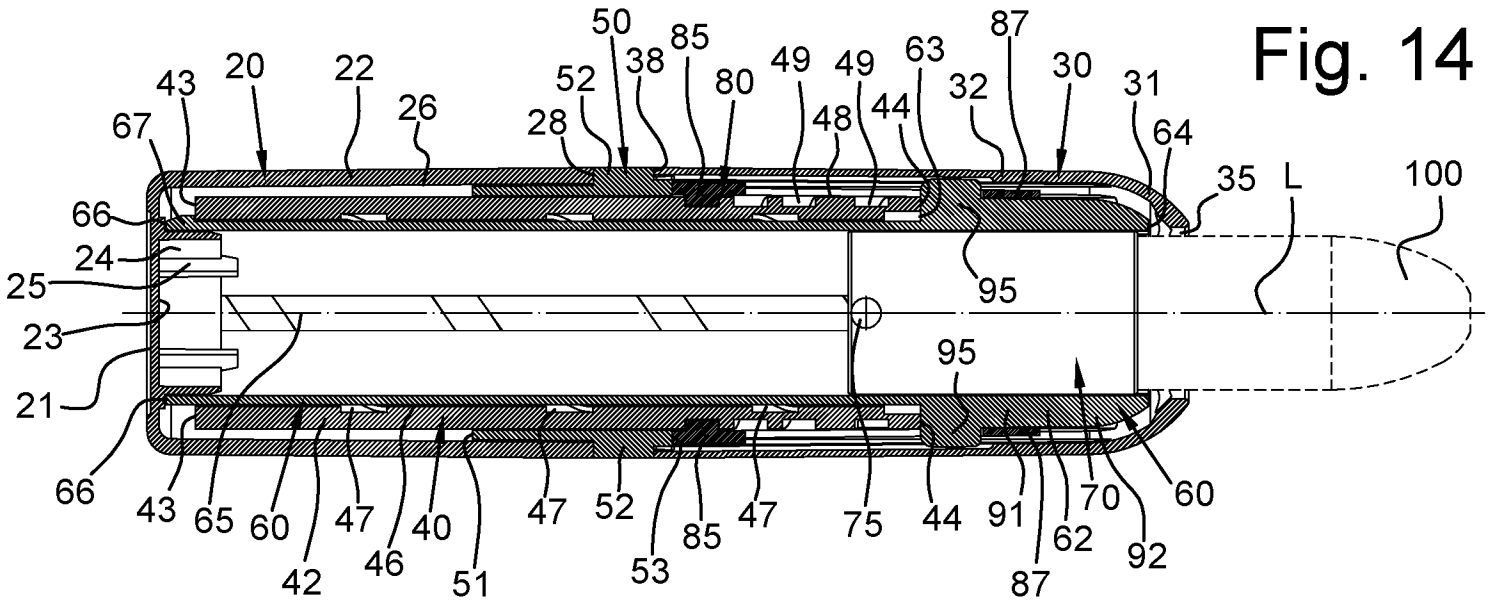
FIG. 14 is a sectional view according to the line XIV-XIV in FIG. 13 without the cosmetic product.
Figure 15:
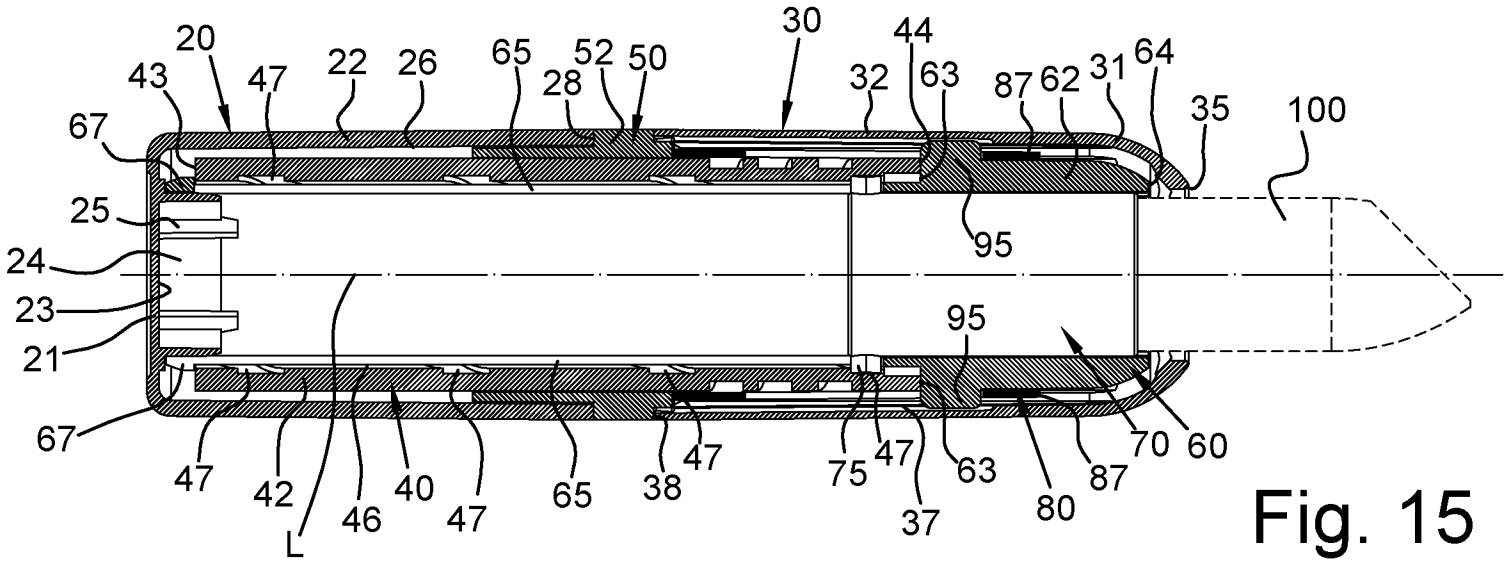
FIG. 15 is a sectional view according to the line XV-XV in FIG. 13 with the cosmetic product.
Figure 16:
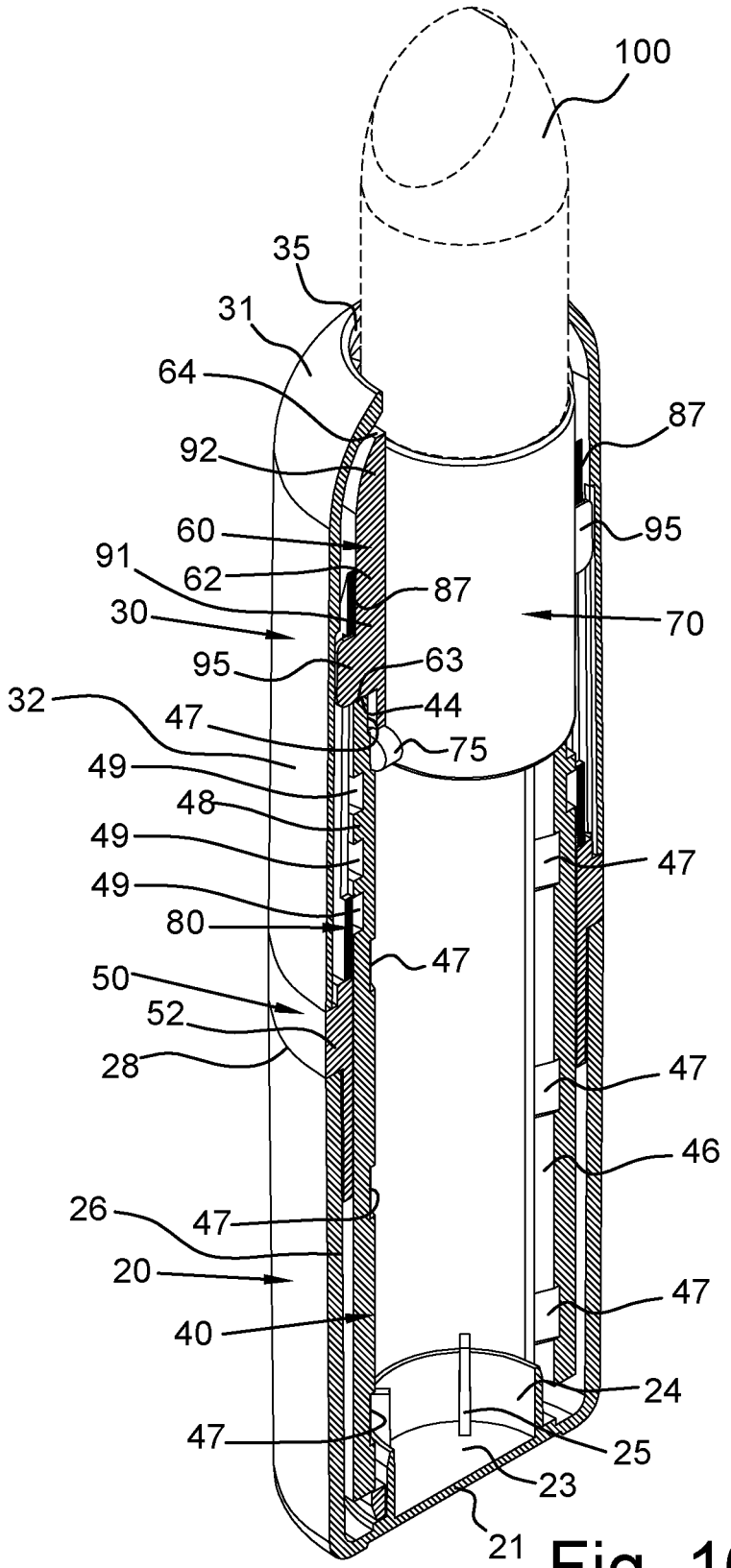
FIG. 16 is a perspective view of the section of FIG. 15.

As shown in particular in FIGS. 9-11, the unbent shutter 80 is a flat shapeable sheet comprising an inner surface 81 and an outer surface 82. The unbent shutter 80 on a plane horizontal geometric plane comprises a first plane two-dimensional rectangular shaped portion comprising two end sides 83, 84, an upper geometric side wherefrom a second portion composed of said plurality of gores 87 extends and a base side which becomes a lower edge of the shutter 80 when it is in the shaped position.

The shutter 80 is adapted to be bending deformed passing from an unbent position shown in FIGS. 9-11 to a bending-shaped position as shown in particular in FIGS. 1, 3-6, 8, 14-16. In the bending-shaped position, the shutter 80 is bending-shaped both about the longitudinal axis L so that two end sides 83, 84 of the shutter 80 match together for forming a hollow cylinder, and by bending the gores 87 for following the hemispherical shapes of the upper portion 92 of the upper portion 62 of the inner cylindrical body 60 and of the upper portion 31 of the upper outer container 30.

The shutter 80 comprises two guide flaps 86 that project from the inner surface 81 of the shutter 80. When the shutter 80 is in the bending-shaped position the two guide flaps 86 project radially towards the outside and each guide flap 86 engages slidingly with one of the plurality of grooves 37 of the upper outer container 30 so that the shutter 80 rotates integrally with the upper outer container 30.

Each guide flap 86 has a complementary shape to that of the cross section of the respective groove 37 of the upper outer container 30 so as to adhere better to the groove to ensure that the shutter 80 is associated with the motion of the upper outer container 30.

The shutter 80 comprises two guide pins 85 that project from the outer surface 82 of the shutter 80.

When the shutter is in the bending-shaped position the two guide pins 85 project radially towards the inside in the direction of the longitudinal axis L. Each guide pin 85 of these two guide pins 85 engages slidingly in one of the two outer helicoidal grooves 49 of the outer cylindrical body 40.

Each guide pin 85 has a cylindrical shape to slide better within the respective outer helicoidal groove 49 of the outer cylindrical body 40.

The shutter 80 comprises a plurality of longitudinal slots 88 that are pass-through.

When the shutter is in the bending-shaped position, each longitudinal slot 88 of the shutter 80 is adapted to be engaged by the respective guide pin 95 of the inner cylindrical body 60 that transports the shutter 80 in the relative rotatory motion of the inner cylindrical body 60 with respect to the outer cylindrical body 40.

Each gore 87 is substantially shaped like an isosceles triangle with the geometric height of the isosceles triangle that follows a parallel line to the longitudinal axis L, where the oblique sides 97 of the isosceles triangle are curved with a convexity facing towards an inner space between two adjacent gores 87. The convex curvature of the oblique sides 97 of the gores 87 advantageously allows them to adhere to each other better when the shutter 80 passes from an open shaped position to a closed shaped position corresponding to the closing position of the pass-through opening 35 of the upper outer container 30.

Figure 3:
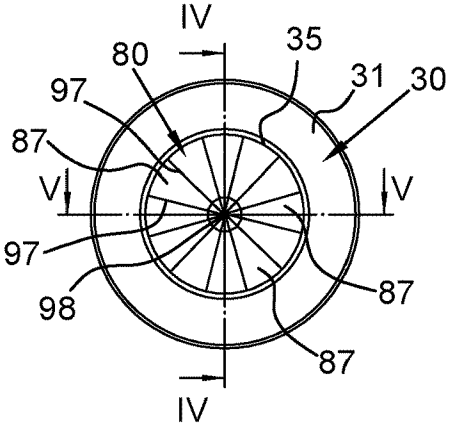
FIG. 3 is a view from above of the cosmetic container in the closed position.

In the closed shaped position of the shutter 80 the tips of the gores 87 are facing towards the longitudinal axis L and adhere to one another to close said pass-through opening 35 as shown in particular in FIGS. 3 and 8.

In the open shaped position of the shutter 80 it is moved downwards by means of two guide pins 85 slidingly engaged with the outer grooves 49 of the outer cylindrical body 40 during the rotation motion of the outer cylindrical body 40 relative to the inner cylindrical body 60. The gores 87 open up as they are distanced from each other and sliding on the upper portion 62 of the inner cylindrical body 60 to an opening position of the pass-through opening 35 of the upper outer container 30 where tips 98 of the gores 87 are completely located inside the compartment obtained between the inner surface 36 of the upper outer container 60 and the upper portion 62 of the inner cylindrical body 60, as shown in particular in FIGS. 13-16.

Each gore 87 of the shutter 80 comprises a side portion 89 which extends from one of the curved oblique sides 97 of the gore 87 and extends towards the inner space between two adjacent gores 87. Each side portion 89 of the gore 87 is advantageously adapted to close in a completely efficient way the pass-through opening 35 of the upper outer container 30 when the shutter 80 is in the closed shaped position. In fact, in the closed shaped position of the shutter 80 the gores 87 adhere to each other making its own curved oblique sides 97 adhere adjacent to each other, but they are compressed between the inner surface 36 of the upper outer container 30 and the upper portion 62 of the inner cylindrical body 60 hence tending to keep the tips of the gores 87 joined, but distancing a side portion of the curved oblique sides 97 from each other, where the side portion 89 is provided that overcomes this drawback by completely closing the shutter 80 when it is in the closed shaped position.

As shown in particular in FIGS. 9 and 11, the side portion 89 is substantially a geometric rectangle comprising two curved long sides 99 corresponding to the curvature of the two oblique sides 97 of the isosceles triangle identified by the single gore 87. The two curved long sides 99 extend for at least a fraction of the length of the curved oblique side 97 of the gore 87 that provides them, covering a central portion of the curved oblique side 97 of the gore 87 that corresponds to the portion that stretches into the closed shaped position of the shutter 80.

As shown in particular in FIG. 11, the inner surface 81 of the shutter 80 comprises a plurality of longitudinal grooves 96 adapted to curve the shutter 80 better making it pass from the unbent position to the bending-shaped position for forming the hollow cylinder. Once bent, the longitudinal grooves 96 allow the shutter 80 to be bent better, presenting its cross section like a polyhedron, as shown in particular in FIG. 8.

Each longitudinal slot 88 comprises two ends adapted to act as a retainer for the corresponding guide flap 95 of the inner cylindrical body 60 so as to stop the sliding of the shutter 80 both downwards and upwards during the relative rotation step of the two inner 60 and outer 40 cylindrical bodies.

During the pulling of the shutter 80 downwards in the rotation step of the two inner 60 and outer 40 cylindrical bodies, the tips of the gores 87 slide on a portion of the outer surface of the upper portion 62 of the inner cylindrical body 60, where this portion of the outer surface of the upper portion 62 is a portion of the upper portion 62 between two adjacent pass-through longitudinal slots 69. In this way, the tips of the gores 87 do not ruin the cosmetic product 100.

In relation to the operation, the relative rotation motion between the inner cylindrical body 60 and the outer cylindrical body 40 can be described in two modes in relation to the body that is considered to be in rotation and the one kept still with respect to the fingers of the user handling the cosmetic container 10.

In a first mode, the user keeps the upper outer container 30 still between his/her fingers and turns the lower outer container 20. During the relative rotatory motion of the lower outer container 20, the outer cylindrical body 40 is integrally associated with the lower outer container 20 by means of the ring nut 50 and the outer cylindrical body 40 rotates about the longitudinal axis L with respect to the inner cylindrical body 60. The shutter 80 is pulled downwards in the longitudinal direction towards the bottom 21 of the lower outer container 20 during the rotatory motion of the outer cylindrical body 40 by means of two guide pins 85 that are slidingly mounted in the two outer helicoidal grooves 49 of the outer cylindrical body 40. The shutter 80 slides downwards having as a guide the longitudinal slots 88 that are slidingly engaged with the guide flaps 95 of the inner cylindrical body 60. The inner cylindrical body 60 is kept still with respect to the rotation motion of the outer cylindrical body 40 as the inner cylindrical body 60 is integrally associated with the shutter by means of the longitudinal slots 88 and by means of the guide slots 86 of the shutter it is kept integral with the grooves 37 of the upper outer container 30 that is kept still by the fingers of the user.

In a second mode, it is possible to describe the rotation motion of the upper outer container 30 with respect to the lower outer container 20 when the user keeps the lower outer container 20 still with his/her fingers or fingertips and turns the upper outer container 30 with his/her fingers. During the rotation of the upper outer container 30, the grooves 37 of the upper outer container 30 engaged with the guide grooves 86 of the shutter 80 make the shutter 80 rotate together with the upper outer container 30. The shutter 80 in turn engages the longitudinal slots 88 thereof with the guide flaps of the inner cylindrical body 60 making it rotate together with the upper outer container 30. The shutter 80 is engaged in the outer grooves 49 of the outer cylindrical body 40 and is therefore pulled downwards by the rotation motion.

In both the operating modes described above during the relative rotation motion of the two inner 60 and outer 40 cylindrical bodies, the support shuttle 70 is pulled upwards in the direction of the longitudinal axis L and towards the through opening 35 of the upper outer container 30 while the shutter 80 is pulled downwards. During the downwards pulling of the shutter 80 the gores 87 of the shutter 87 are opened making the pass-through opening 35 pass from a closed position to an open position.

The inner wall of the upper portion 31 of the upper outer container 30, the longitudinal grooves 37 of the lower portion 32 of the upper outer container 30 and the outer surface of the upper portion of the inner cylindrical body 60 constitute a guide compartment within which the shutter 80 is guided, deforming by bending.

Alternatively, the outer shape of the lower 20 and upper 30 outer container may be parallelepiped.

Alternatively, the lower 20 and upper 30 outer containers comprise a cross section with the same diameter, where the cross sections correspond at least to the portions of the two outer containers 20, 30 that are in abutment against the ring nut 50.

Alternatively it is possible to envisage that the ring nut 50 and the outer cylindrical body 40 are a single part.

Alternatively, it is possible to envisage that the outer cylindrical body 40 and the lower outer container 20 are a single part.

Also alternatively, it is possible to envisage that the outer cylindrical body 40, the lower outer container 20 and the ring nut 50 are a single part.

Alternatively, it is possible to envisage that each of the grooves 37 of the lower portion 32 of the upper outer container 30 hollows a seat in the lower portion 32 starting from the open lower geometric base 38 of the lower portion 32 of the upper outer container 30 to a fraction of length of the lower portion 32 measured starting from the open lower geometric base 38 and proceeding towards the pass-through opening 35.

Alternatively, it is possible to envisage that the upper portion 31 of the upper outer container 30 comprises walls shaped like a hollow geometric hemisphere and truncated by two geometric planes that are not parallel to each other and the upper portion 92 of the upper portion 62 of the inner cylindrical body 60 comprises walls shaped like a hollow geometric hemisphere and truncated by another two geometric planes not parallel to each other.

Alternatively, it is possible to envisage that the double inner helicoidal groove 47 extends for a fraction of the length of the inner surface 46 of the outer cylindrical body 40.

Alternatively, it is possible to envisage that the support shuttle 70 comprises only one guide pin 75 and therefore that the inner cylindrical body 60 comprises only one longitudinal guide slot 65 and the outer cylindrical body 40 comprises only one inner helicoidal groove 47.

Alternatively the shutter 80 does not comprise guide flaps 86. In this alternative, the guide flaps 95 of the inner cylindrical body 60 pass through the longitudinal slots 88 of the shutter 80 and engage with the grooves 37 of the upper outer container 30 acting in the same way as the guide flaps 86 of the shutter and pulling the upper outer container 30 into the relative rotation motion between the inner cylindrical body 60 and the outer cylindrical body 40.

Alternatively, it is envisaged that said inner cylindrical body 60 and/or said upper outer container 30 comprise guide elements 95, 37 coupled to complementary guide elements 86, 88 of the shutter 80 adapted for the shutter 80 sliding.

Alternatively, it is envisaged that the longitudinal slots 88 of the shutter 80 are not pass-through, but are grooves hollowed in the inner surface 81 of the shutter 80 to be engaged by sliding with said guide flaps 95 of the inner cylindrical body 60.

Alternatively, it is possible to envisage that the upper portion 62 of the inner cylindrical body 60 does not comprise pass-through longitudinal slots 69 and that the upper portion 62 is a continuous surface.

Alternatively, it is possible to envisage that only the gores 87 of the shutter 80 can be shaped by bending. In this alternative, it is possible to envisage that the upper outer container 30 comprises at least one inner wall, that the inner cylindrical container 60 comprises at least one outer surface, where the gores 87 of the shutter 80 are arranged between this at least one inner wall and this at least one outer surface that act as a guide for the gores 87.

The invention thus conceived is susceptible to many modifications and variants, all falling within the same inventive concept; furthermore, all details can be replaced by equivalent technical elements. In practice, the materials used, as well as the dimensions, can be of any type according to the technical requirements.

The invention claimed is:

1. A cosmetic container comprising at an end a closable pass-through opening for a cosmetic product, an outer cylindrical body which comprises at least one inner helicoidal groove and at least one outer helicoidal groove, an inner cylindrical body which is rotatably mounted with the outer cylindrical body about a longitudinal axis along which they are concentric, wherein said inner cylindrical body comprises at least one longitudinal guide slot, a support shuttle for said cosmetic product comprising at least one guide pin which is slidingly engaged with said at least one longitudinal guide slot and with said at least one inner helicoidal groove, wherein said inner helicoidal groove wraps around said longitudinal axis according to a first direction and said outer helicoidal groove wraps around said longitudinal axis according to a second direction opposite to said first direction, coaxially with respect to the longitudinal axis a shutter comprising at least one guide pin which is slidingly engaged with said at least one outer helicoidal groove, said shutter comprising a plurality of gores at an upper end, said gores being adapted to be bending deformed by passing said shutter from a closed shaped position to an open shaped position, wherein said closed shaped position closes the pass-through opening and said open shaped position does not interfere with the pass-through opening, wherein said closed shaped position provides that said plurality of gores are bent towards said longitudinal axis and adhere one another for closing said pass-through opening, wherein said open shaped position provides that said plurality of gores space each other apart making said pass-through opening pass into an open configuration, said cosmetic container further comprising an upper outer container which comprises said pass-through opening for the cosmetic product, said upper outer container comprises at least one upper outer container inner guide wall, said inner cylindrical body comprises at least one inner cylindrical body outer guide surface, wherein gores of said shutter are arranged and guided between said at least one upper outer container inner guide wall and said at least one inner cylindrical body outer guide surface, and wherein said inner cylindrical body and/or said upper outer container comprise guide elements coupled to complementary guide elements of the shutter adapted for the shutter sliding.

2. The cosmetic container according to claim 1, wherein said upper outer container comprises an upper portion comprising said at least one upper container inner guide wall which is shaped as a hollow geometric hemisphere and truncated by two geometric planes wherein the inner cylindrical body comprises an upper portion which comprises an upper portion which comprises said at least one outer guide surface which is shaped as a hollow geometric hemisphere and truncated by two other geometric planes.

3. The cosmetic container according to claim 1, wherein said inner cylindrical body comprises at least one guide flap, wherein said shutter comprises at least one longitudinal slot, wherein said at least one guide flap is slidingly engaged with said at least one longitudinal slot.

4. The cosmetic container according to claim 1, wherein said upper outer container comprises an inner wall comprising at least one groove, wherein said at least one guide flap slidingly mounts said shutter with said at least one groove.

5. The cosmetic container according to claim 1, wherein said at least one inner helicoidal groove has a first pitch different from a second pitch of said at least one outer helicoidal groove, wherein the first pitch is regular for the whole length of said at least one inner helicoidal groove and wherein the second pitch is regular for the whole length of said at least one outer helicoidal groove.

6. The cosmetic container according to claim 5, wherein the first pitch of said at least one inner helicoidal groove is greater than the second pitch of said at least one outer helicoidal groove.

7. The cosmetic container according to claim 1, wherein each gore of said plurality of gores of said shutter comprises curved oblique sides with a convexity faced towards an inner space between two adjacent gores of the plurality of gores.

8. The cosmetic container according to claim 7, wherein each gore of the shutter comprises a side portion which extends from one of the oblique sides of the gore and extends towards the inner space between two adjacent gores.

9. The cosmetic container according to claim 2, wherein said inner cylindrical body comprises a lower portion and said upper portion, wherein said lower portion comprises said at least one longitudinal guide slot, wherein said upper portion comprises in turn a lower portion and said upper portion, wherein said lower portion of the upper portion of the inner cylindrical body is shaped as a hollow geometric cylinder, wherein the upper portion of the upper portion of the inner cylindrical body, comprises said at least outer surface shaped as a hollow geometric hemisphere and truncated by two other geometric planes parallel between them and perpendicular to the longitudinal axis.

10. The cosmetic container according to claim 2, wherein said upper outer container comprises a lower portion and said upper portion, wherein the lower portion is shaped as a hollow geometric cylinder, wherein said upper portion comprises said at least one upper container inner guide wall shaped as a hollow geometric hemisphere and truncated by two geometric planes parallel between them and perpendicular to the longitudinal axis.

11. The cosmetic container according to claim 1, wherein said outer cylindrical body comprises walls extending along directions parallel to said longitudinal axis and in turn comprising an inner surface hollowed with said at least one inner helicoidal groove and an outer surface hollowed with said at least one outer helicoidal groove.

12. The cosmetic container according to claim 11, wherein said at least one outer helicoidal groove extends lengthwise along a fraction of a length of the outer surface of the outer cylindrical body, wherein said at least one outer helicoidal groove is provided at an upper portion of the outer cylindrical body, wherein the upper portion is at an upper pass-through opening of the outer cylindrical body.

13. The cosmetic container according to claim 2, wherein said shutter is adapted to be bending deformed by passing from an unbent position to a shaped position, wherein the unbent position of said shutter on a plane horizontal geometric plane provides that said shutter comprises a first portion shaped as a plane bi-dimensional rectangle comprising two end sides, an upper geometric side wherefrom a second portion composed of said plurality of gores extends and a base side which becomes a lower edge of the shutter when it is in the shaped position, wherein the bending-shaped position of the shutter provides that said shutter is bending-shaped both about the longitudinal axis so that two end sides of the shutter match together for forming a hollow cylinder, and by bending said plurality of gores for following the hemispherical shapes of the upper portion of the upper portion of the inner cylindrical body and of the upper portion of the outer upper container.

* * * * *